United States Patent [19]

Johnson

[11] Patent Number: 4,468,930

[45] Date of Patent: Sep. 4, 1984

[54] FREEZE CRYSTALLIZATION SUBASSEMBLY

[75] Inventor: Wallace E. Johnson, Topsfield, Mass.

[73] Assignee: Concentration Specialists, Inc., Andover, Mass.

[21] Appl. No.: 371,658

[22] Filed: Apr. 26, 1982

[51] Int. Cl.[3] ..... F28F 5/00; F28F 19/00

[52] U.S. Cl. ..... 62/71; 62/348; 62/354; 62/544; 165/94; 165/95

[58] Field of Search ..... 62/71, 348, 354, 544; 165/94, 95; 15/3.51

[56] References Cited

U.S. PATENT DOCUMENTS

| | | | |
|---|---|---|---|
| 2,066,431 | 1/1937 | Taylor | 62/354 X |
| 2,890,239 | 6/1959 | Quigg | 62/544 X |
| 3,259,179 | 7/1966 | Leach | 165/95 |
| 3,342,040 | 9/1967 | Dedricks et al. | 62/71 X |
| 3,406,741 | 10/1968 | Leach | 165/94 X |
| 3,507,319 | 4/1970 | Kogan | 165/95 X |
| 4,124,065 | 11/1978 | Leitner et al. | 165/95 |
| 4,192,151 | 3/1980 | Carpenter | 62/348 X |

FOREIGN PATENT DOCUMENTS

| | | | |
|---|---|---|---|
| 2127715 | 12/1972 | Fed. Rep. of Germany | 165/95 |
| 1308703 | 12/1962 | France | 165/95 |

*Primary Examiner*—Sheldon J. Richter

*Attorney, Agent, or Firm*—Abraham Ogman

[57] ABSTRACT

The invention is directed to a freeze crystallization subassembly having means for continuously removing crystals formed on a heat transfer surface from the surface. A scraper shuttle is moved across the heat transfer surface by a fluid being refrigerated to remove crystals from the surface. The crystals are carried to a mixer where they are mixed with incoming feed until a circulating slurry is produced. Means is provided to remove slurry from the mixer.

4 Claims, 7 Drawing Figures

FREEZE CRYSTALLIZATION SUBASSEMBLY

BACKGROUND OF THE INVENTION

Freeze concentration systems are commonly used for desalting and for food processing. The technique involves producing a slurry from a feedstream containing a solution of at least one dissolved substance. The slurry comprises a concentrated mother liquor and crystals of one (or more) of the substances in solution. The crystals are separated from the mother liquor in a wash column or other purifier. In some cases the concentrate is the desired product. In other cases, the crystals are the desired product. In either case the rapid efficient production of crystals is vital.

A vital and necessary part of a freeze concentration system is the freeze crystallizer which converts the feedstream to the aforementioned slurry. The freeze crystallizer must produce crystals efficiently and be uniformly distributed in the mother liquor.

A common form of crystallizer uses indirect heat transfer. That is to say the feedstream or slurry is separated from the refrigerant by a heat transfer surface. The crystals formed on the heat transfer surface must not be permitted to accumulate and must be removed as soon as possible after being formed.

Heretofore, motor-driven scrapers have been the mainstay of devices for cleaning deposits from heat transfer surfaces. Representative of such devices are the Scraped Surface Exchangers made by Vogt Products of Louisville, Ky, using doctor blades and auger-type scrapers. They are clumsy, complicated, and difficult to maintain. The reason for this is quite obvious, as doctor blades and auger-type scrapers require motors, chain drives, guard seals, and, of course, augers.

A so-called "Amertap" condenser utilizes nonrigid balls circulated in the condenser tubes. These devices are also quite complicated and represent that each tube receives a ball on the average of every 5 minutes.

Scrapers have been used in evaporators or other heat exchange apparatus to remove scale and other deposits from the walls of the heat exchangers. The scale and other deposits were then removed from the system. For purposes of this discussion, the term "scale" will be used to designate deposits from liquids which are ancillary and generally deleterious to the heating processes and generally to be avoided, if possible. The scale and other deposits were treated as waste products and were not distributed back into the fluid being treated and recirculated.

One such heat exchanger is described in U.S. Pat. No. 3,259,179 to J. M. Leach. In particular, the Leach apparatus is devised for a heat exchanger used in an evaporation converter to desalt sea or brackish water. Salt or other raw water is admitted through openings into tubes where it is evaporated.

Precipitates accumulate scale generally on the walls of the tubes. The accumulated scale reduces the rate of heat transfer through the walls of the tubes causing a deterioration of efficiency. In accordance with the Leach patent, to remove the accumulated deposit, the evaporation process is stopped, and a large piston pushes many scrapers a short distance until they reach outlet. The scrapers are then hydraulically forced across the internal surface of the tubes, thereby scraping off scale from the surface of the tubes. The scrapers are returned to their original position after the scale is flushed out and the evaporation process is started again.

Another method is shown in U.S. Pat. No. 3,406,741, also to J. M. Leach. A batch-type liquid treatment is carried out. Piston-like scrapers are moved through cylinders by the movement of the liquid being treated. After the treatment of a particular batch is completed, the treated liquid is removed, and another batch is supplied.

The concepts described and claimed herein are simple and require no special tube surface requirements. There are no mechanical drives. The construction is compact, and the concept lends itself to scaling to desired capacity. The system also functions independent of crystallizer orientation.

All of the foregoing have been made possible in crystallizers in contrast to other devices which produce an undesirable scale such as evaporators because of a fundamental difference between the mode of operation and the results obtained by the crystallizers and other devices.

In a crystallizer the desired product is the crystals. They are to be removed as quickly as possible. They are to be recycled through the crystallizer to encourage growth. In the case of ice crystals (the most frequent form of crystal encountered) research has shown that the ice does not adhere tenaciously and may be easily harvested from the crystallizer surface, provided that it is removed quickly, typically every ten seconds. Consequently, simple and far less rugged methods as described herein may be employed for removal.

Having observed and discovered the foregoing, a number of significant and novel objects are proposed.

It is an object of the invention to provide a freeze crystallizer subassembly which overcomes the limitations and disadvantages of such prior art devices.

It is another object of the invention to provide a freeze crystallization subassembly which places crystals formed on heat transfer walls into the slurry immediately after the crystals are formed to discourage the crystals from grouping into less treatable clumps.

It is yet another object of the invention to provide means for continuously scraping the surfaces of the heat transfer walls to insure maximum heat transfer through the walls.

It is yet another object of the invention to provide means for continuously recirculating scraper balls through a crystallizer.

It is still another object of the invention to provide heat transfer means utilizing rigid scraper balls.

It is yet another object of the invention to define a freeze crystallizer process wherein crystals are formed in a heat transfer surface and are continuously scraped and recirculated and generally processed for use in concentration systems.

It is a further object of the invention to provide a freeze crystallizer means using scrapers in each heat exchanger tube in combination with means for synchronizing the movement of the individual scrapers.

In accordance with the invention, a freeze crystallizer for producing a slurry containing a mother liquor and crystals from a feed solution of at least two substances having different freezing points comprises a reservoir for receiving said feed, for storing slurry, and for supplying slurry. In addition, a heat exchanger is included. The heat exchanger has a freezer compartment for circulating refrigerant and a slurry compartment in which the slurry is circulated. The freezer and slurry compartments are separated by heat transfer walls. A movable scraper means is situated within the slurry compartment. It is configured to transverse and scrape the heat transfer walls. Slurry circulating means interconnecting the reservoir and the slurry compartment for circulating slurry from said reservoir through the slurry compartment and back to the reservoir is also provided. The circulating slurry is programmed to reciprocate the scraper means in the slurry compartment to scrape the heat transfer walls.

Also in accordance with the invention is a process for producing a slurry of a mother liquor and a solute from a feed solution of at least two substances with different freezing points comprising the steps of supplying the feed solution to a slurry reservoir, removing slurry from the reservoir and circulating it through a heat exchanger where the slurry is separated from a refrigerant by heat transfer walls and then back to said reservoir. The circulating slurry is used to reciprocate a scraper immersed in the slurry to clean the heat transfer walls.

The novel features that are considered characteristic of the invention are set forth in the appended claims; the invention itself, however, both as to its organization and method of operation, together with additional objects and advantages hereof, will best be understood from the following description of a specific embodiment when read in conjunction with the accompanying drawings in which:

DESCRIPTION OF THE INVENTION

Figure 1:
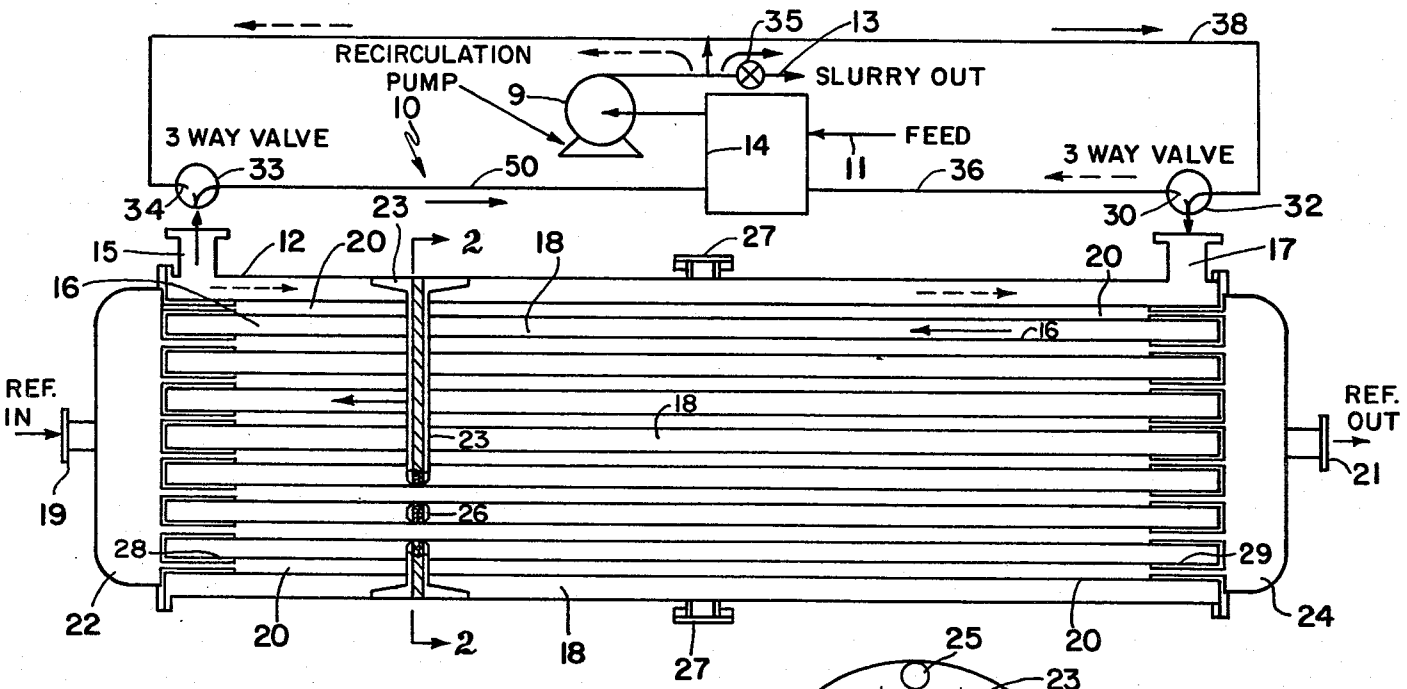
FIG. 1 is a schematic representation of a freeze crystallizer embodying the present invention. One mode of operation is depicted.

Referring to FIG. 1, there is shown a freeze crystallizer subassembly 10 containing a heat exchanger or crystallizer 12, a reservoir or mixer 14, a pump 9, and an assortment of valves and conduits to be identified below.

The crystallizer 12 contains typically one or more refrigerant compartments 18 through which refrigerant is circulated from an input 19 and out through an exit 21. A left plenum 22 and a right plenum 24 are connected by one (or more) tubes 20 through which refrigerant is circulated.

Slurry is supplied to the crystallizer by either of ports 15 or 17 and removed from the other as will become clear. The slurry flows across the outside surfaces 16 of the tubes 20 in the spaces 18. In the aggregate, a slurry compartment is formed.

Figure 2:
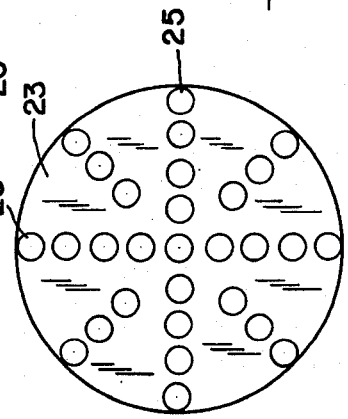
FIG. 2 is a section taken along lines 2—2 in FIG. 1.

A piston 23 (see FIGS. 1 and 2) is situated within the spaces 18 and contains a plurality of holes 25 through which tubes 20 pass. Piston 23 is thus able to move longitudinally relative to the tubes 20.

Piston 23 is a double-walled structure containing scraper granules 26 between the walls which are in contact with the exterior surfaces 16 of the tubes 20. The scraper granules remove crystals from these surfaces as the piston 23 moves relative to the tubes 20. A pair of plugs 27 are provided to fill the piston 23 with granules 26 when the piston is positioned between the plugs 27.

Numerals 28 and 29 represent those portions of the ends of the refrigerated tubes which are insulated (preferably with a low thermal conductivity plastic coating) to prevent ice growth and adhesion in the areas beyond the piston travel.

The reservoir 14 is supplied feed through conduit 11. Slurry is removed from the crystallizer subassembly 10 through the conduit 13. In this FIG. 1, the slurry is carried from the reservoir 14 by pump 9 through conduit 38 to open valve 32 to the right port 17. The flow of slurry into port 17 moves the piston 23 to the left toward left port 15. As it traverses over the tubes 20, it scrapes crystals from the exterior surfaces 16. The slurry ahead of the shuttle leaves through port 15 through open valve 33 and returns to the reservoir 14 through conduit 50.

When the piston 23 reaches the port 15, a control circuit (not shown) rotates valve 32 and valve 33 so that slurry will flow through the dashed paths 30 and 34. Referring to FIG. 1, the pump 9 now supplies slurry through valve 33 via path 34. The flow of slurry from left to right moves the piston 23 to the right. The slurry ahead of the piston 23 leaves the heat exchanger 12 through valve 32 via path 30 and returns to the reservoir 14 and conduit 36.

When the freeze crystallizer subassembly is first turned on, the fluid flowing through the freeze crystallizer contains no crystals. Eventually crystals are formed and moved to the reservoir 14. In practice, preferably 10 percent of the slurry flowing through the crystallizer 12 is continuously removed for further treatment through valve 35 and conduit 13. The remainder is recirculated from the reservoir 14 to the crystallizer 12, and more crystals are produced. Up to 25 percent of the slurry may be removed from the reservoir 14 and the remainder recirculated through the crystallizer 12. Preformed crystals grow. The feed makes up for the loss of the slurry removed from the subassembly for further treatment.

Eventually, a steady-state condition occurs wherein a slurry exists in the reservoir 14 and crystallizer 12. Feed is supplied through conduit 11 to replace the slurry removed from the reservoir 14. The ratio of crystals to mother liquor will vary depending on the concentration of the feedstream and the freezing temperature of the crystallizer 12. The discussion assumes a steady-state condition.

Figure 3:
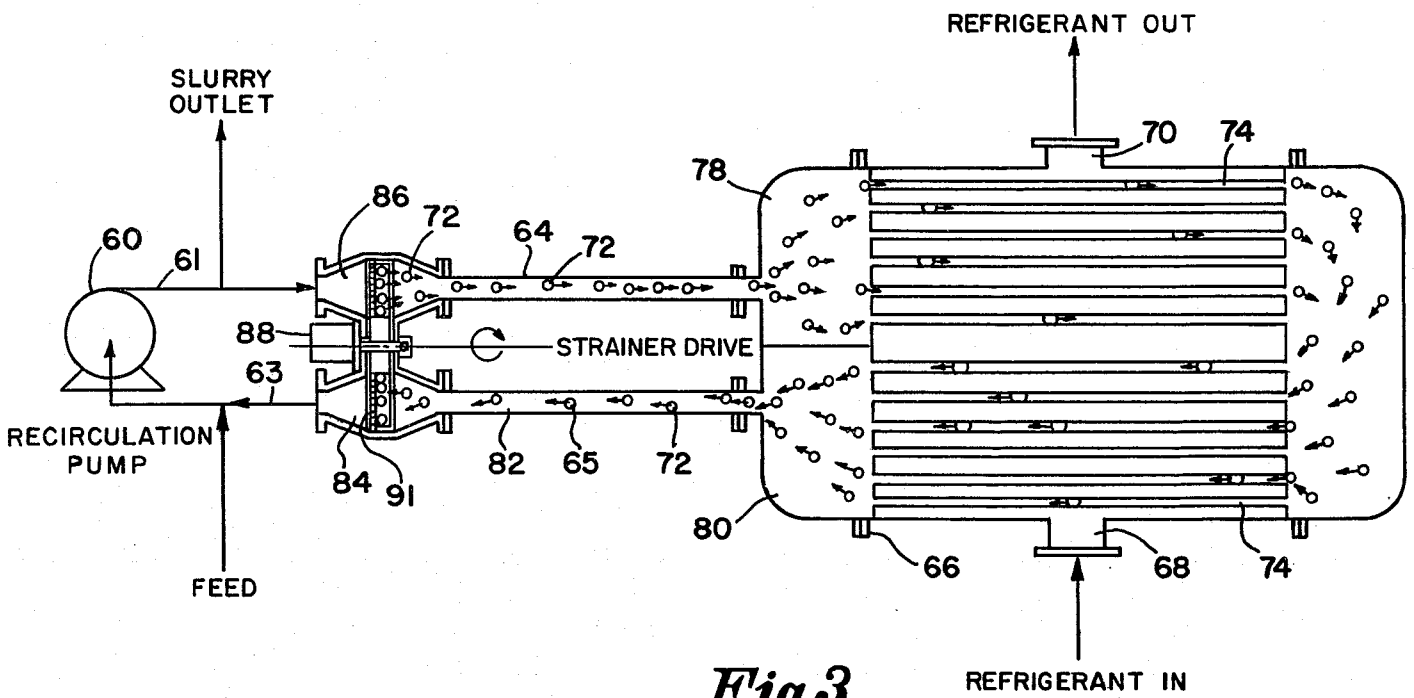
FIG. 3 is a schematic representation of an embodiment using balls as scrapers.
Figure 5:
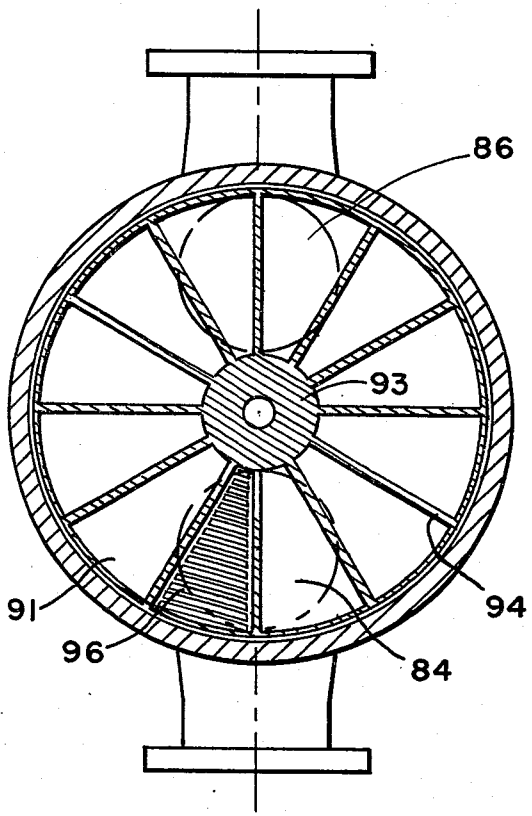
FIG. 5 is a section taken along lines 5—5 in FIG. 4.
Figure 4:
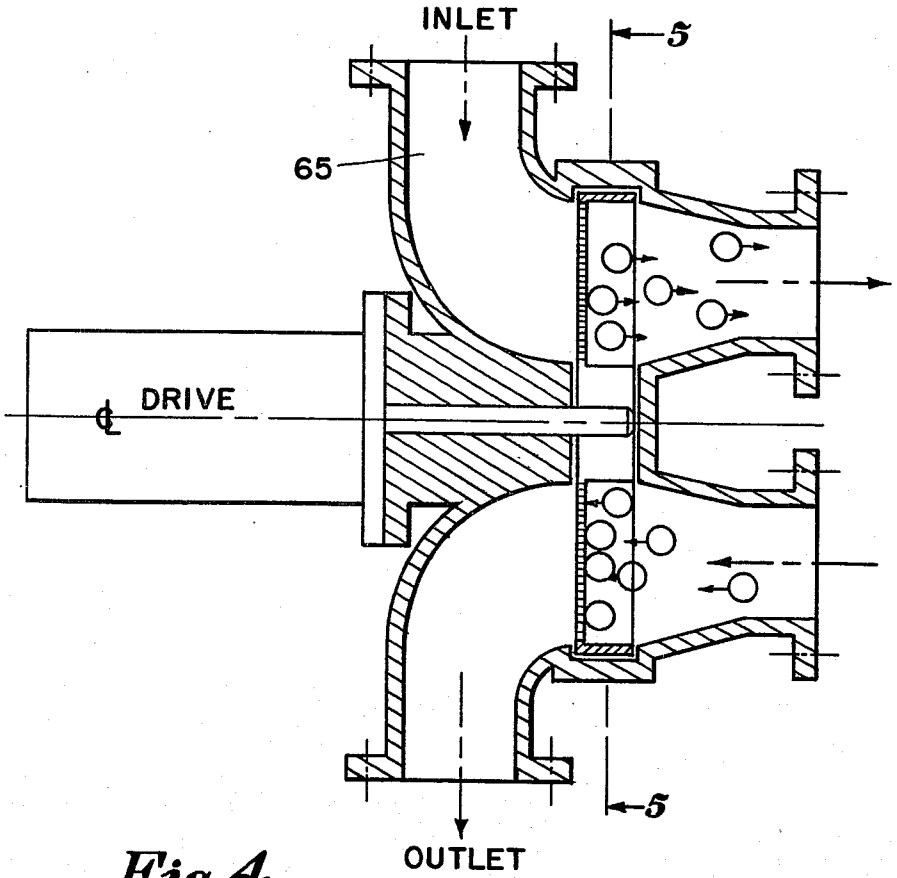
FIG. 4 is an enlarged sectional view of the FIG. 3 strainer.

Referring now to FIGS. 3, 4, and 5, an alternate embodiment of the invention will be described. In the apparatus of FIG. 3, a unidirectional flow crystallizer is shown. The crystallizer is provided with an inlet for refrigerant at 68 and an outlet at 70. Refrigerant at a low temperature is introduced at 68 and circulated around the exterior of tubes 74. Slurry is circulated through tubes 74 by recirculation pump 60. The inlet port to the crystallizer is at 86. Thus recirculation pump 60 pumps slurry along conduit 61 into the inlet port 86 through rotatable strainer wheel 91 along conduit 64 and into chamber 78 of crystallizer 66.

Along with the slurry, a plurality of objects such as nylon balls 72 having a density close to the fluid in the tubes are disposed within the crystallizer 66.

In applications providing ice crystals or other non-tenacious films, rigid balls can be used. In heat exchanger cleaning where scale is being removed at infrequent intervals (minutes), the scale buildup varies with time between cleaning. Further, it will vary as a function of the contents in the liquid. The buildup along the length of a particular tube will also vary.

In the case of scale, it is necessary to totally remove the scale because it inhibits heat transfer to and from the fluid in the bulk flow; whereas in crystallization, the desired reaction is the formation of crystals at the heat transfer surface.

The nonuniformity of scale mandates the use of non-rigid scrapers and scrapers dimensionally larger than the tubes. The clearance and lack of rigidity permit the scrapers to clean nonuniform films and films of varying thickness. Unexpectedly, continuous scraping of very thin and weakly-adhering films such as ice permits the use of rigid, unyielding scrapers with a small clearance between the scraper and the tube.

Furthermore, the crystallizer chamber is partitioned into two segments—an upper inlet segment 78 and a lower outlet segment 80. The balls, or similar rigid objects, 72, are caused to flow through tubes 74 from left to right as viewed in FIG. 3 and then are sucked out the lower half of the crystallization chamber by pump 60 through the lower outlet segment of tubes 74 into lower chamber 80 through conduit 82 and into the rotatable strainer wheel section where they are entrapped by the strainer wheel 91 and prevented by the screen 96 from being discharged through the discharge port 84 and out conduit 63.

The screen 96 is capable of being rotated by motor 88 which is rotatably attached to the rotating wheel 91. This wheel may be continuously rotated, or periodically rotated, such that, as balls 72 are accumulated in the lower portion or discharge section of the crystallizer apparatus, they are carried up to the inlet section and recirculated through tubes 74. In this manner, there is provided a continuous flow of scraper objects through the tubes 74 to scrape buildup of crystallized ice on the interior surfaces of said tubes 74.

Holes or slots 96 (see FIG. 5) are provided in the rotating screen 96 sufficiently large to permit scraped ice particles to pass through the strainer, yet prevent the scraper objects 72 from passing through. Note: For simplicity, only one set of slots are shown in FIG. 5. However, it should be understood that 12 such sets as in the case shown are utilized in the screen. Seal bars 94 radiate axially from the hub 93 of the strainer wheel 91. These seal bars prevent the slurry at the inlet port 86 from passing directly to the outlet port 84.

Figure 6:
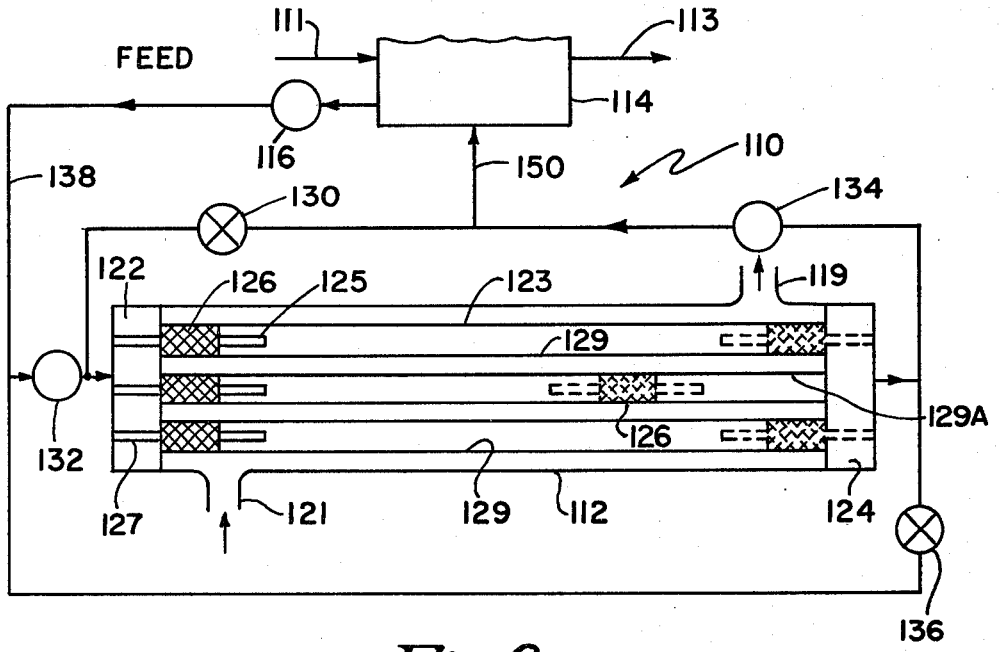
FIG. 6 is yet another embodiment utilizing individual shuttle scrapers.

FIG. 6 shows a freeze crystallization subassembly 110 wherein each tube carrying slurry has its own individual shuttle for scraping the heat transfer surface clean of crystals. A feature of this system is a means for assuring that all the shuttles reach the end of their travel before the flow of slurry is reversed.

As before, feed is supplied via a conduit 111 to a reservoir 114 and slurry is removed via a conduit 113.

A pump 116 removes slurry from the reservoir 114 and supplies slurry to the freeze crystallizer 112 via conduit 138 and open valve 132 to a plenum 122. Refrigerant is supplied to the crystallizer 112 through the opening 121 and removed through the opening 119.

A plurality of aligned tubes 123 traverse the length of the crystallizer 112 opening into plenum 122 on the left and a right plenum 124. Slurry is circulated through the crystallizer 112 through the tubes 123.

Disposed in each tube is a shuttle 126 which is designed to reciprocate through tubes 123 and scrape crystals from the heat transfer surface 129 of the tubes. Each shuttle 126 contains left and right stops 127 and 125, respectively. The stops 127 and 125 stop the movement of the shuttles when they bear against the wall of a plenum as illustrated in FIG. 6.

Referring to FIG. 6, all of the shuttles 126 are shown at the left end of their travel. Since valve 132 is open, the pump 116 is supplying slurry to plenum 122. The movement of slurry into plenum 122 will move the shuttles toward the right. The slurry within the tubes 123 ahead of the shuttle will exit via plenum 124 and return to the reservoir 114 via open valve 134 and conduit 150.

Ideally, all of the shuttles will move uniformly through the tubes 123 and arrive at the right terminus at about the same time. When this happens, consistently all of the tubes are scraped uniformly and with the utmost efficiency.

One, however, has to anticipate that such uniformity will not occur, so it is necessary to take measures to assure that all shuttles 126 will terminate their travel in the time alloted by the control system. In this case, the control can be no more complicated than a timing device which will alternatively open valves 132 and 134 while closing valves 130 and 136 and vice versa.

The dotted outlines of shuttles 126 near the right terminus illustrate that the central shuttle is lagging, for whatever reason, behind the other two which have reached the terminus. Since it is likely that crystals will continue to build up on the heat transfer surface 129A to the right of the center shuttle unless it is scraped, it is also likely that the center shuttle will have increasing difficulty scraping this portion of the tubes unless the shuttle is pushed to the right terminus.

Figure 7:
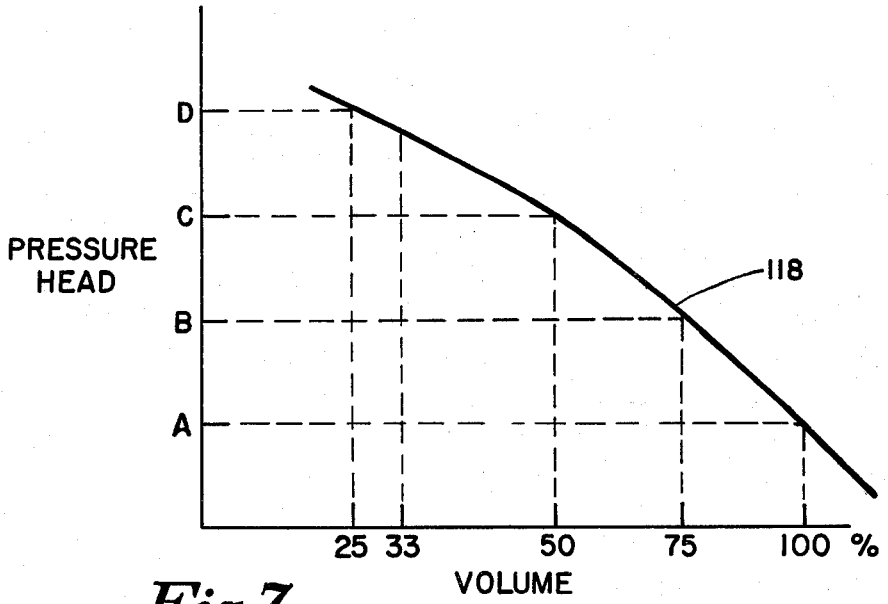
FIG. 7 is a curve useful to describe the operation of the FIG. 6 embodiment.

The means for assuring that each shuttle will completely traverse its particular tube is embodied in this case in the pump 116. This pump is a centrifugal pump with a steep head versus capacity curve. Such pumps are available in industry. A positive displacement pump could be used and generally has a steeper head versus capacity curve. Referring to FIG. 7, there is a curve 118 which represents the head or pressure built up in the pump 116 as a function of the amount of slurry flowing through the pump. When 100 percent of its design flow occurs, the head built up in the pump is at A. If, for some reason the flow is decreased to 50 percent, the head built up in the pump is at higher valve C. At 25 percent flow, a still higher head D is generated.

In the case illustrated in FIG. 6, it may be presumed that 33 percent of the slurry circulated through the crystallizer flows through each of the three tubes 123. When all the shuttles are moving through the tubes at the same rate, it may be presumed that the head or pressure built up in the pump is at A. In the case illustrated, two of the shuttles 126 have ended their travel while the center shuttle appears hung up. The shuttles at the right terminus will act as blockage decreasing or stopping the flow of slurry in their respective tubes. When this happens, the flow of slurry through the crystallizer drops at least two thirds.

If the center shuttle is totally hung up, the flow of slurry through the crystallizer drops to zero. The head or pressure in the pump 116 in this case will build up to a level above D which represents a flow rate of 25 percent. The higher than normal pressure against the center shuttle will break it loose and move it toward the right terminus. If normal movement of the center shuttle is resumed, it may be presumed that the driving pressure will continue to be as high as at C and accelerate the shuttle to the end of its travel.

The various features and advantages of the invention are thought to be clear from the foregoing description. Various other feature sand advantages not specifically enumerated will undoubtedly occur to those versed in the art, as likewise will many variations and modifications of the preferred embodiment illustrated, all of which may be achieved without departing from the spirit and scope of the invention as defined by the following claims.

I claim:

1. A process for producing a slurry containing concentrated mother liquor and ice crystals from a water solution feedstream comprising the steps of:

(a) supplying said feedstream to a slurry reservoir;

(b) circulating slurry from said reservoir through a crystallizer where ice is deposited on heat exchange surfaces of the crystallizer;

(c) providing scrapers immersed in said slurry for removing the ice from said heat exchange surfaces;

(d) utilizing the pressure of circulating slurry to reciprocate said scrapers across the surfaces of said walls; and (e) removing slurry from said reservoir.

2. A process as defined in claim 1 where 10% of the slurry is continuously removed from the reservoir.

3. A process as defined in claim 1 where up to 25% of the slurry is continuously removed from the reservoir.

4. A process as defined in claim 1 wherein the pressure for moving said shuttles is varied inversely as the volume flowing in the crystallizer.

* * * * *

UNITED STATES PATENT AND TRADEMARK OFFICE

CERTIFICATE OF CORRECTION

PATENT NO. : 4,468,930

DATED : September 4, 1984

INVENTOR(S) : Wallace E. Johnson

It is certified that error appears in the above-identified patent and that said Letters Patent are hereby corrected as shown below:

Column 3, line 3, please change "transverse" to --traverse--.

Column 6, line 28, please change "alternatively" to --alternately--.

Column 7, line 9, please change "feature sand" to --features and--.

Signed and Sealed this

*Fifth* Day of *March 1985*

[SEAL]

*Attest:*

DONALD J. QUIGG

*Attesting Officer* *Acting Commissioner of Patents and Trademarks*